US007185400B2

(12) United States Patent
Himi et al.

(10) Patent No.: US 7,185,400 B2
(45) Date of Patent: Mar. 6, 2007

(54) TOP END STOP OF SLIDE FASTENER

(75) Inventors: Naoyuki Himi, Toyama-ken (JP); Youhei Kaetsu, Toyama-ken (JP)

(73) Assignee: YKK Corporation, Tokyo (JP)

( * ) Notice: Subject to any disclaimer, the term of this patent is extended or adjusted under 35 U.S.C. 154(b) by 14 days.

(21) Appl. No.: 10/931,669

(22) Filed: Sep. 1, 2004

(65) Prior Publication Data

US 2005/0060847 A1 Mar. 24, 2005

(30) Foreign Application Priority Data

Sep. 19, 2003 (JP) ..... 2003-327665
Mar. 30, 2004 (JP) ..... 2004-098645

(51) Int. Cl.
*A44B 19/36* (2006.01)

(52) U.S. Cl. ..... 24/436; 24/388; 24/387; 24/435

(58) Field of Classification Search ..... 24/388, 24/387, 436, 435, 409
See application file for complete search history.

(56) References Cited

U.S. PATENT DOCUMENTS 2,044,161 A * 6/1936 Forster ..... 24/436
3,070,306 A * 12/1962 Du Bois ..... 708/835
3,862,474 A * 1/1975 Ebata ..... 24/436
4,109,349 A * 8/1978 Tanaka ..... 24/436
4,232,431 A 11/1980 Akashi
4,878,275 A * 11/1989 Kazui et al. ..... 24/436
6,070,306 A * 6/2000 Wang ..... 24/436
6,327,755 B1 12/2001 Wang

FOREIGN PATENT DOCUMENTS

EP 0387368 A1 9/1990
GB 2352371 A 1/2001
JP 2-239804 9/1990

* cited by examiner

*Primary Examiner*—Robert J. Sandy
*Assistant Examiner*—Marcus Menezes
(74) *Attorney, Agent, or Firm*—Everest Intellectual Property Law Group; Michael S. Leonard

(57) ABSTRACT

A top end stop of a slide fastener is attached to fastener stringers on a box pin side, and has a first side face opposing a guide column of a slider and a second side face on an opposite side. The first side face has first and second opposing side faces intersecting at an angle of 140° to 150°, and an interval A between the first opposing side face and the second side face being larger than a width C of an element aisle of the slider. An interval B between the second opposing side face and the second side face being equal to or smaller than the width C. A cut-out is provided as a stopper at a position on the second side face at a width E from the first opposing side face.

9 Claims, 15 Drawing Sheets

TOP END STOP OF SLIDE FASTENER

BACKGROUND OF THE INVENTION

1. Field of the Invention

The present invention relates to a top end stop of a slide fastener in which fastener chains thereof are formed by injection-molding fastener elements of thermoplastic resin on side edges of fastener tapes and an opening device is attached to an end portion of the fastener chain or an inverse opening device is attached to the end portion of the fastener chain.

2. Description of the Related Art

Generally, thermoplastic resin fastener elements are molded on side edges of fastener tapes with injection molding means and then by removing the fastener elements at a predetermined interval from this continuous fastener chain, a space portion is prepared. A slider or two sliders is/are inserted through this space portion such that they oppose each other face to face and then, an opening device is formed at an end of the space portion by molding a resin box, a box pin and a separable pin or an inverse opening device is formed by molding a box and a separable pin. After a top end stop of resin is molded at the other end, the space portion is cut out so as to finally produce an open type slide fastener with an opening device or an open type slide fastener with an inverse opening device.

This open type slide fastener is sewed onto an opening portion of clothes or the like after it is separated to its right and left stringers. At this time, a slider placed on the stringer on the box pin side becomes an obstacle to sewing operation, thereby disturbing a smooth sewing operation. Further, there is another problem that even if the slider is demanded to be replaced with a different one, this is impossible.

Thus, the top end stop disclosed in Japanese Patent Laid-Open Publication No. 2-239804 has been considered. This top end stop 110 shown in FIG. 18 is mounted on an end portion of the stringer on the box pin side of the open type slide fastener. The maximum width $W_3$ of the top end stop 110, measured at right angle to the inner edge of the stringer, is larger than a width $W_4$ of one side of element aisles 124 of the slider 121. A first half body portion 110*a* and a second half body portion 110*b* of the top end stop 110 are constructed so that an inward concave face 135 is generated therebetween, which engages a guide column 122 through an obtuse angle. Respective axes $A_1$, $A_2$ of the first and second half body portions 110*a*, 110*b* are tilted inward with respect to the inner edge of the fastener tape 128 and the maximum widths $W_1$, $W_2$ of the first and second half body portions 110*a*, 110*b* are formed to be equal to or slightly smaller than the width $W_4$ of the element aisle 124.

As for the top end stop 110 of the open type slide fastener shown in FIG. 18, the maximum width measured at right angle to the inner edge of the fastener tape 128 is larger than the width of the element aisle 124 and therefore, so designed that the top end stop 110 is incapable of passing through the element aisle 124 of the slider 121 only if it is moved linearly. Further, the respective maximum widths $W_3$ of the first and second half body portions 110*a*, 110*b* are formed to be equal to or slightly smaller than the width of the element aisle 124 of the slider 121, so that if the top end stop 110 is moved along a inverted letter C, it is capable of passing through the element aisle 124. When it is intended to close the fastener chain on usage, if the slider 121 is pulled strongly, the slider 121 can escape from the fastener chain because there is no mechanism for stopping the slider 121 positively. Further, when the fastener chains are disconnected and opened, there is a fear that the slider 121 may surpass the top end stop 110 and drop out.

The present invention has been accomplished in views of the above-described problem.

A first object of the present invention is to provide a top end stop to be mounted on an open type slide fastener with an opening device or an open type slide fastener with an inverse opening device. Upon its normal usage condition, the slider keeps contact with a stop portion provided on the top end stop, for example, a cut-out to stop the sliding of the slider, thereby keeping the slider from dropping off. When the slider needs to be removed from the fastener chain, if the slider loaded on the fastener stringers is pulled while rolled in the right direction or in the left direction, the slider can be removed easily. Thus, when sewing the stringers along an opening in clothes or the like, the stringers are sewed thereon without the slider, and thereafter, when the slider is inserted in the fastener stringer, the slider can be inserted while being rolled in an opposite direction to the above-mentioned pulling-out direction. When replacing the slider of the fastener chain sewed onto clothes or the like, this top end stop allows the slider to be replaced easily. Again, the first object is to provide a top end stop having both the configuration and condition for exerting its excellent functions.

A second object of the present invention, in addition to the above first object, is to provide a top end stop of an open type slide fastener which has an excellent function for loading or removing the slider by specifying the configuration and condition of the top end stop and allows the slider to be loaded or removed easily.

A third object of the present invention, in addition to the above first object, is to provide a top end stop of an open type slide fastener having excellent quality in which upon normal usage of the fastener chain, when the slider is stopped by the same top end stop, the slider never swings or deflects without any clear cause.

A fourth object of the present invention, in addition to the above first object, is to provide a top end stop of an open type slide fastener which, by specifying the configuration of the opposing side face opposing the guide column of the slider, is capable of exerting its excellent introducing function.

A fifth and a sixth objects of the present invention, in addition to the above first object respectively, are to provide a top end stop of an open type slide fastener which enables the slider to be set or removed smoothly on or from the fastener stringer through the operation of loading or unloading the slider while rolling in the right direction or in the left direction.

A seventh object of the present invention, in addition to the above first object, is to provide a top end stop of an open type slide fastener, which enables the slider to be set on the fastener stringer smoothly and loaded on the fastener stringer easily when the slider is set on the stringer.

A eighth object of the present invention, in addition to the above first object, is to provide a top end stop of an open type slide fastener which, by specifying the configuration of the top end stop to enable the slider to be set or removed easily, enables the slider to be set or removed smoothly when the slider is set on or removed from the stringer.

A ninth object of the present invention, in addition to the above first object, is to provide a top end stop of an open type slide fastener in which even if the slider is pulled with a weak force when the slider is set on or removed from the stringer, the slider can be set or removed.

SUMMARY OF THE INVENTION

To achieve the above objects, as the main feature of the invention, the invention provides a top end stop of a slide fastener comprising an opening device or an inverse opening device having a box pin and a separable pin at an end portion of a pair of fastener stringers, the top end stop being attached adjacent to a top end of plurality of fastener elements on a side of a box pin and capable of passing through an element aisle provided in a slider by changing its posture, being characterized in that the top end stop is comprised of an opposing side face opposing a guide column of the slider and an opposite side face on an opposite side to the opposing side face, while a cut-out for engaging a flange of the slider is provided in the opposite side face.

As a result of executing the above-described feature of the present invention, the following effects are exerted.

In the top end stop of slide fastener provided with the opening device or the inverse opening device, on normal usage condition, the slider makes contact with the cut-out in the top end stop so as to stop its sliding and thus the slider cannot be slid any more. Thus, the slider is never dropped out of the stringer on the box pin side. However, when the slider needs to be removed from the fastener chain, for example, when the stringers are sewed onto an opening portion of clothes or the like, if the slider is pulled out while tilting outward with respect to the stringer, it can be removed smoothly. After the stringers without the slider are sewed, if the slider is pulled while tilting its bottom portion outward with respect to the stringer, it can be set easily. Further, the slider can be replaced during usage of the slide fastener. This aspect of the invention is optimum as means for producing the open type slide fastener all at once by injection molding the fastener elements and the top end stop to a fastener tape together with the opening device or inverse opening device made of resin.

Preferably, the opposing side face of the top end stop has a first opposing side face and a second opposing side face, an interval A between the first opposing side face and the opposite side face is formed to be larger than a width C of the element aisle between the guide column and the flange of the slider, while an interval B between the second opposing side face and the opposite side face is formed to be equal to or smaller than the width C of the element aisle between the guide column and the flange of the slider.

As a result, the top end stop stops the slider securely not permitting the slider to pass through the element aisle on normal condition and if necessary, allows it to pass through the element aisle as an easy way, thereby enabling the slider to be set on or removed from the fastener stringer securely.

Preferably, the cut-out of the top end stop has an upper side portion and a lower side portion, the upper side portion makes contact with a front end of the flange and an interval E between the lower side portion and the opposing side face is formed to be equal to or slightly smaller than the width C of the element aisle.

As a result, on normal operation condition, the slider is introduced to the cut-out in the top end stop smoothly and stopped, thereby preventing the slider from swinging or deflecting without any particular reason.

Preferably, the opposing side face of the top end stop has the first opposing side face and the second opposing side face and the first opposing side face and the second opposing side face intersect at an angle of 140° to 150°.

As a result, the top end stop can be introduced into the element aisle smoothly thereby enabling the slider to be removed from or set on the stringer smoothly.

Preferably, the opposing side face of the top end stop has the first opposing side face, the first opposing side face of the top end stop is disposed on a side adjacent to the fastener elements and the second opposing side face is disposed on a side of a top end face of the top end stop, such that it adjoins the first opposing side face and the second opposing side face is tilted inward.

As a result, when loading the slider on the fastener stringer, it can be set smoothly by loading while rolling in the right direction with respect to the stringer and further, by carrying out the removal operation while rolling the slider in the same manner, it can be removed from the stringer easily and smoothly.

Preferably, the opposing side face of the top end stop has the first opposing side face and the second opposing side face, the first opposing side face is disposed on the side of the top end face of the top end stop and the second opposing side face is disposed on the side adjacent to the fastener elements, such that it adjoins the first opposing side face and the second opposing side face is formed to be tilted inward.

As a result, when loading the slider on the fastener stringer, it can be set smoothly by loading while rolling in the left direction with respect to the stringer and further, by carrying out the removal operation while rolling the slider in the same manner, it can be removed from the stringer easily and smoothly.

Preferably, the opposing side face of the top end stop has the first opposing side face and the second opposing side face, the opposite side face to the second opposing side face is formed such that it is narrowed gradually from an outer end of the cut-out toward the top end face of the top end stop.

As a result, when loading the slider on the fastener stringer, the slider can be guided smoothly and set on the stringer easily because the top end stop loaded on the stringer is constructed such that it is narrowed gradually toward its front end.

Preferably, a projecting portion projecting toward the side of the fastener elements is formed at a portion in which the opposing side face intersects a bottom end face opposing the adjacent fastener elements.

As a result, when loading the slider on the stringer, the V-shaped front end of the guide column prevents the slider from biting in between the forefront of the elements and the top end stop, thereby achieving a smooth loading operation.

Preferably, the opposing side face of the top end stop has the first opposing side face, one face of the top end stop is so formed that the first opposing side face and the opposite side face are in parallel to each other and an interval D therebetween is equal to or smaller than the width C of the element aisle.

As a result, when loading or unloading the slider on/from the stringer, it can be operated even with a weak pulling force because only a small resistance is generated. As described above, the effects which the present invention achieves are very remarkable.

DESCRIPTION OF THE PREFERRED EMBODIMENTS

Figure 1:
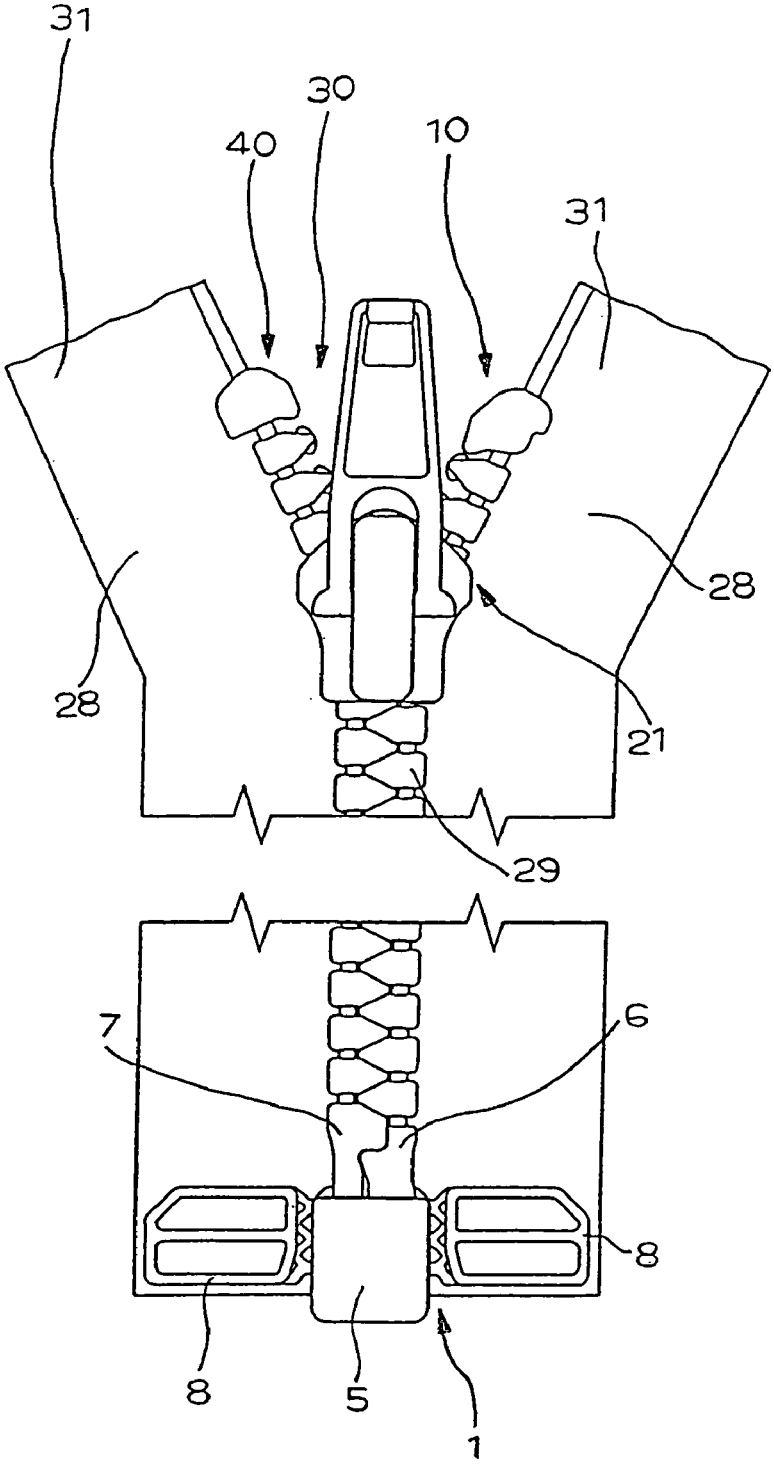
FIG. 1 is a front view of a slide fastener with an opening device according to a first embodiment of the present invention.

Hereinafter, preferred embodiments of the present invention will be specifically described with reference to the drawings.

As for a top end stop of an open type slide fastener of the present invention, fastener elements 29, a box 5, a box pin 6, a separable pin 7, a reinforcement portion 8 and a top end stop 10 are formed on side edges of a fastener tape 28 using thermoplastic resin such as polyacetal and polyamide with injection molding means or mono-filaments of polyamide or polyester are formed in a coil shape or zigzag shape and mounted on the side edge of the fastener tape 28. After an endless fastener chain 30 is formed, a space portion is provided at a predetermined interval and at an end of this space portion, the box 5, box pin 6 and separable pin 7 are molded while the top end stop 10 is molded with the injection molding means, so as to produce the fastener chain 30 having an opening device. Further, a fastener chain having an inverse opening device is also molded in the same way.

The top end stop 10 is adjoined and molded integrally with fastener elements 29 in fastener stringers 31 provided with an opening device 1 comprised of the box 5 and the box pin 6 or provided with an inverse opening device 2 comprised of the box pin 6 in the open type slide fastener. As for the configuration of the top end stop 10, preferably, an opposing side face 20 which opposes the side face of a guide column 22 of the slider 21 is formed of a first opposing side face 11 and a second opposing side face 12, which are provided with 140° to 150° defined therebetween. The first opposing side face 11 is disposed adjacent to the fastener element 29 of the fastener stringer 31 and the second opposing side face 12 is disposed on the side of the top end face 15 of the top end stop 10 such that it adjoins the first opposing side face 11. The first opposing side face 11 is located on a line X formed by connecting front ends of heads 32 of the respective fastener elements 29 of the fastener stringer 31 and the second opposing side face 12 is formed obliquely such that it is inclined toward the inward of the top end stop 10. Alternatively, the first opposing side face 11 is disposed on the side of the top end face 15 of the top end stop 10 while the second opposing side face 12 is disposed on the side adjacent to the fastener element 29 of the fastener stringer 31, such that it adjoins the first opposing side face 11. In this case also, the first opposing side face 11 is located on a line X formed by connecting the front ends of the heads 32 of the fastener elements 29 of the fastener stringer 31 while the second opposing side face 12 is formed obliquely such that it is inclined toward the inward of the top end stop 10.

The interval A between the first opposing side face 11 and an opposite side face 13 on an opposite side thereof is formed larger than the interval B between the second opposing side face 12 and the opposite side face 13. The interval B between the second opposing side face 12 and the opposite side face 13 is equal to or smaller than the width C of the element aisle 24 on the side face of the-guide column 22. A cut-out 17 which a front end of the flange 23 of the slider 21 is capable of engaging is formed in this opposite side face 13 and a lower side portion 18 of this cut-out 17 is so formed that the interval E between it and the first opposing side face 11 is equal to or slightly smaller than the width C of the element aisle 24 between the guide column 22 of the slider 21 and the flange 23 and the first opposing side face 11 is parallel to the lower side portion 18. By providing the proximal portion of the cut-out 17 with a circularly dropped step portion 33, the flange 23 of the slider 21 is guided smoothly. Therefore, in this top end stop 10, the interval E between the root of an upper side face 19 of the cut-out 17 which the step portion 33 make contact with and the first opposing side face 11 is equal to or slightly smaller than the width C between the guide column 22 of the slider 21 and the flange 23. The opposite side face 13 is formed such that it narrows from an outside end of the cut-out 17 toward the top end face 15 of the top end stop 10, not in parallel to the second opposing side face 12. Consequently, the fastener stringer 31 can be inserted smoothly into the slider 21.

(First Embodiment)

A general concept about an opening device and an inverse opening device will be described first. The opening device and the inverse opening device are attached adjacent to fastener elements on a bottom end portion of each of right and left fastener stringers in which the fastener elements are attached along a side edge of the fastener tape in the longitudinal direction thereof, in order to couple or decouple the bottom end portions of the right and left fastener stringers.

As shown in FIG. 1, the opening device 1 is comprised of a separable pin 7, a box pin 6 and a box 5. By inserting the separable pin 7 mounted on one fastener stringer 31 into the box 5 mounted on the other fastener stringer 31, the bottom end portions of the right and left fastener stringers 31 are joined together. Further, by pulling out the separable pin 7 inserted into the box 5, the bottom end portions of the right and left fastener stringers 31 are disconnected and released.

Figure 7:
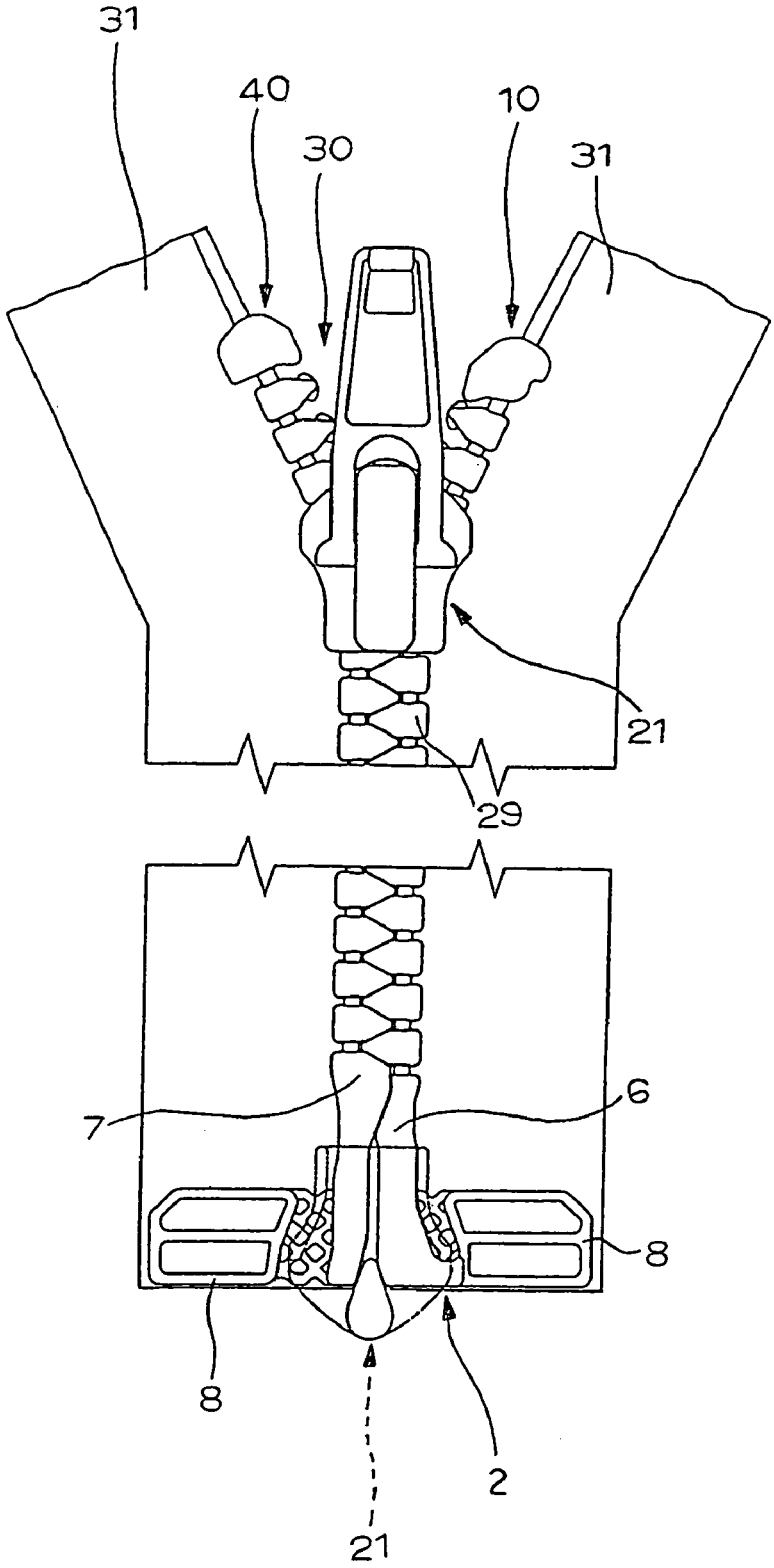
FIG. 7 is a front view of a slide fastener with an inverse opening device according to a second embodiment of the present invention.

As for the inverse opening device 2, as shown in FIG. 7, instead of the separable pin 7, the box pin 6 and the box 5, a slider 21 is inserted in an opposite direction and with this slider 21 kept in contact with the box pin 6, the separable pin 7 attached to one fastener stringer 31 is inserted into the slider 21, so that the bottom end portions of the right and left fastener stringers 31 are joined together. Further, by pulling out the separable pin 7 from the slider 21, the bottom end portions of the right and left fastener stringers 31 are decoupled. Furthermore, by sliding the slider 21 upward of the right and left fastener stringers 31 with the separable pin 7 inserted, the fastener elements 29 are separated from the bottom end portion of the slide fastener, so as to release the slide fastener.

In the slider 21, an upper plate 25 and a lower plate 26 disposed up and down in parallel are joined with a guide column 22 so as to form an element aisle 24 between the upper plate 25 and the lower plate 26. Flanges 23 are provided to protrude inward from right and left side edges of the upper plate 25 and the lower plate 26 and entry and exit of the fastener elements 29 into/from the slider 21 are guided with the guide column 22 and the flanges 23. By sliding the slider 21, the fastener elements 29 of the pair of fastener stringers 31 pass through the element aisles 24 so that they engages or disengages from each other. In the meantime, the flanges 23 may be provided on only any one of the upper plate 25 and the lower plate 26.

In the slide fastener of the first embodiment shown in FIGS. 1 to 6, as shown in FIG. 1, the slide fastener having the opening device 1 at an end portion of the fastener chain 30 is provided with the top end stop 10. The box 5, the box pin 6 and a reinforcement portion 8 are formed at an end of a fastener tape 28 using thermoplastic resin and the fastener elements 29 of a predetermined length are formed on the side edge of each fastener tape 28 and then, the top end stop 10 is formed adjacent to this fastener elements 29. On the other hand, the separable pin 7 and the reinforcement portion 8 are formed at an end of the other fastener tape 28 and the fastener elements 29 of the predetermined length are formed on the side edge of the fastener tape 28 and then, the top end stop 40 is formed adjacent to this fastener elements 29.

Figure 2:
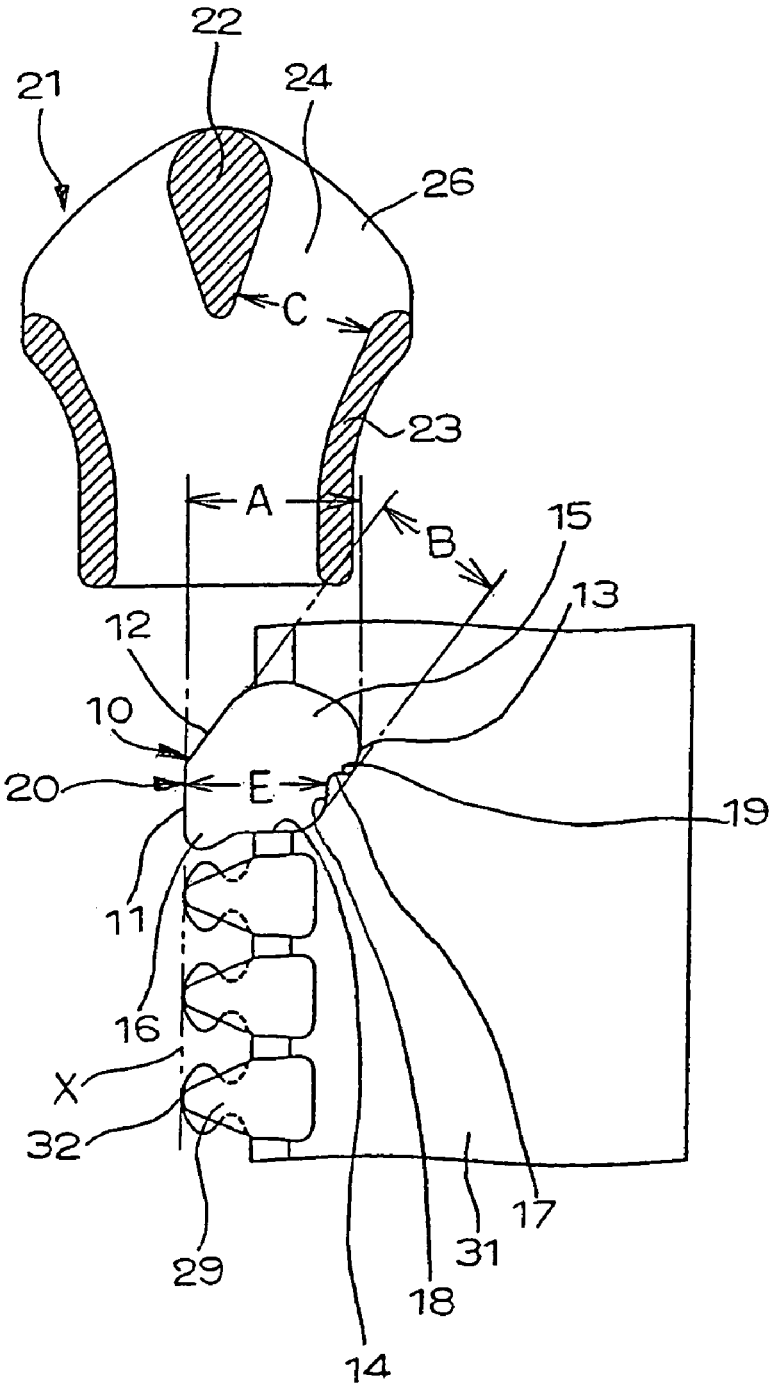
FIG. 2 is an operation explanatory view showing a condition just before a top end stop is inserted into a slider of the same slide fastener.

The top end stop 10 formed at the end of the fastener stringer 31 having the box pin 6 has an opposing side face 20, which opposes the side face of the guide column 22 of the slider 21 as shown in FIG. 2. The opposing side face 20 comprises a first opposing side face 11 which is located on a side adjacent to the fastener elements 29 and a second opposing side face 12 which is located on the end portion side of the fastener stringer 31. The first opposing side face 11 and the second opposing side face 12 are constructed such that they intersect at an angle in a range of 140° to 150°.

As for the relation between the first opposing side face 11 and the second opposing side face 12, the first opposing side face 11 is disposed on a side adjacent to the fastener elements 29 of the fastener stringer 31 while the second opposing side face 12 is disposed on the side of the top end face 15 of the top end stop 10 such that it is joined to the first opposing side face 11. The first opposing side face 11 is formed so as to protrude from the edge portion of the fastener stringer 31 such that the side face 11 is located on a line X formed by connecting the front ends of heads 32 of the fastener elements 29 of the fastener stringer 31. The top end of the second opposing side face 12 is so formed obliquely that it is inclined toward the inward of the top end stop 10, that is, the inward of the fastener stringer 31.

The interval A between the first opposing side face 11 and an opposing side face 13 on its opposite side is formed larger than the interval B between the second opposing side 12 face and the opposing side face 13 in parallel and on the opposite side of the second opposing side face 12. The interval B between the second opposing side face 12 and the opposing side face 13 is formed to be equal to or smaller than the width C of the element aisle 24 between the guide column 22 in the slider 21 and the flange 23. Consequently, the second opposing side face 12 and the opposing side face 13 can pass through the element aisle 24 between the guide column 22 of the slider 21 and the flange 23.

The opposing side face 13 in parallel to the second opposing side face 12 has a cut-out 17 which the front end of the flange 23 in the slider 21 is capable of engaging. This cut-out 17 has an upper side portion 19 and a lower side portion 18. The upper side portion 19 extends in a direction of leaving the side edge of the fastener tape 28, so that when the slider 21 is slid, it is located at a path in which the front end of the flange 23 moves and keeps contact with the front end of the flange 23, thereby keeping the slider 21 from sliding further. The lower side portion 18 of the cut-out 17 or the fastener element 29 side is formed in parallel to the first opposing side face 11. The interval E between the first opposing side face 11 and the lower side portion 18 is formed to be equal to or slightly smaller than the width C of the element aisle 24 between the guide column 22 and the flange 23. Consequently, in a state in which the flange 23 makes contact with the upper side portion 19 of the cut-out 17 and kept in an engagement condition, the first opposing side face 11 opposes the guide column 22, and the lower side portion 18 opposes the flange 23, thereby blocking the top end stop 10 from playing within the element aisle 24.

The first opposing side face 11 and a bottom end face 14 opposing the fastener element 29 are formed such that they intersect at right angle. A projecting portion 16 which circularly projects is provided at a corner portion in which the first opposing side face 11 and the bottom end face 14 intersect each other at right angle. The top end face 15 on an opposite side of the bottom end face 14 is formed into a circular face, thereby allowing the slider 21 to be inserted smoothly. Further, a contact point between the first opposing side face 11 and the second opposing side face 12 is formed into a circular face, thereby allowing the slider 21 to pass through the element aisle 24 smoothly. The front surface of the top end stop 10 has been described above. The rear surface of the top end stop 10 may be formed in an identical shape to the front surface. However, the rear surface side of the top end stop 10 is so constructed that the first opposing side face 11 and the opposing side face 13 are formed in parallel to each other while the interval D therebetween is equal to or smaller than the width C of the element aisle 24 of the slider 21 and no cut-out 17 is formed. Consequently, the top end stop 10 can pass through the element aisle 24 of the slider 21 smoothly even with small tensile force. Thus, not so much resistance is generated when the slider 21 is inserted.

Figure 3:
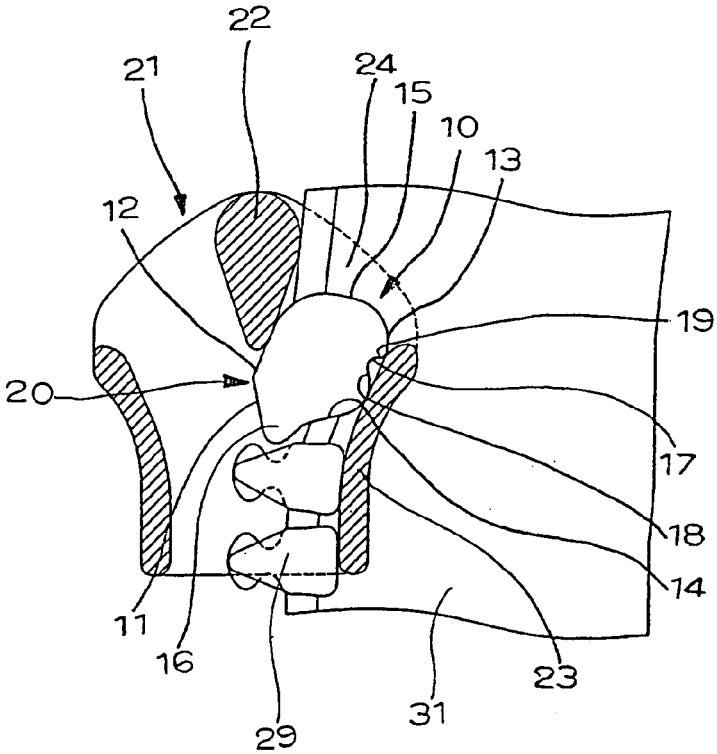
FIG. 3 is an operation explanatory view showing a condition in which the top end stop is inserted into the slider of the same slide fastener and passes through an element aisle between a guide column and a flange.

The usage condition of the top end stop 10 will be described. To pass the top end of the fastener stringer 31 into the slider 21 as shown in FIG. 2, it is inserted into the element aisle 24 between the guide column 22 and the flange 23 of the slider 21 as shown in FIG. 3, so that its posture changes, thereby tilting and passing through the element aisle 24. As for the posture when passing through, the second opposing side face 12 of the top end stop 10 opposes the guide column 22 of the slider 21, and the opposite side face 13 of the top end stop 10 opposes the flange 23 of the slider 21. Because the interval B between the second opposing side face 12 and the opposing side face 13 is equal to or smaller than the width C of the element aisle 24 between the guide column 22 and the flange 23, the top end stop 10 can pass through the element aisle 24.

Figure 4:
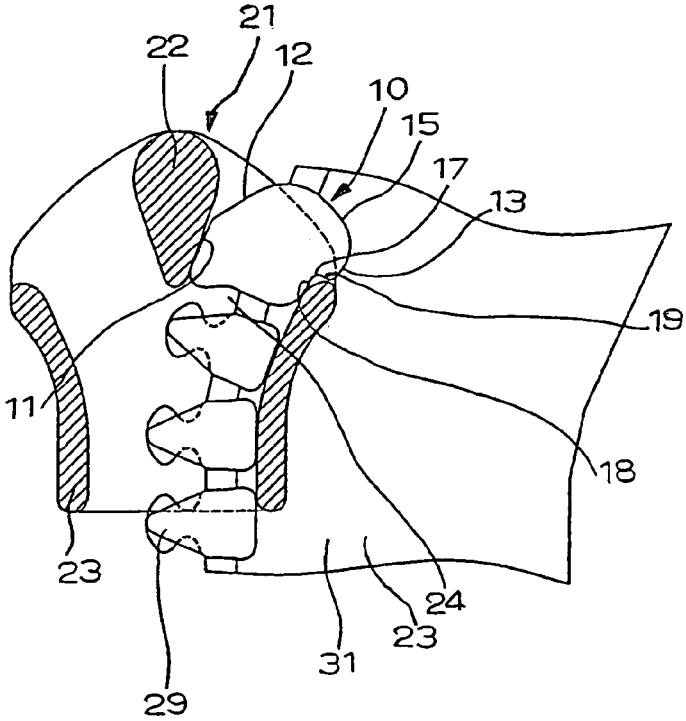
FIG. 4 is an operation explanatory view showing a condition in which the top end stop of the same slide fastener engages a flange.
Figure 5:
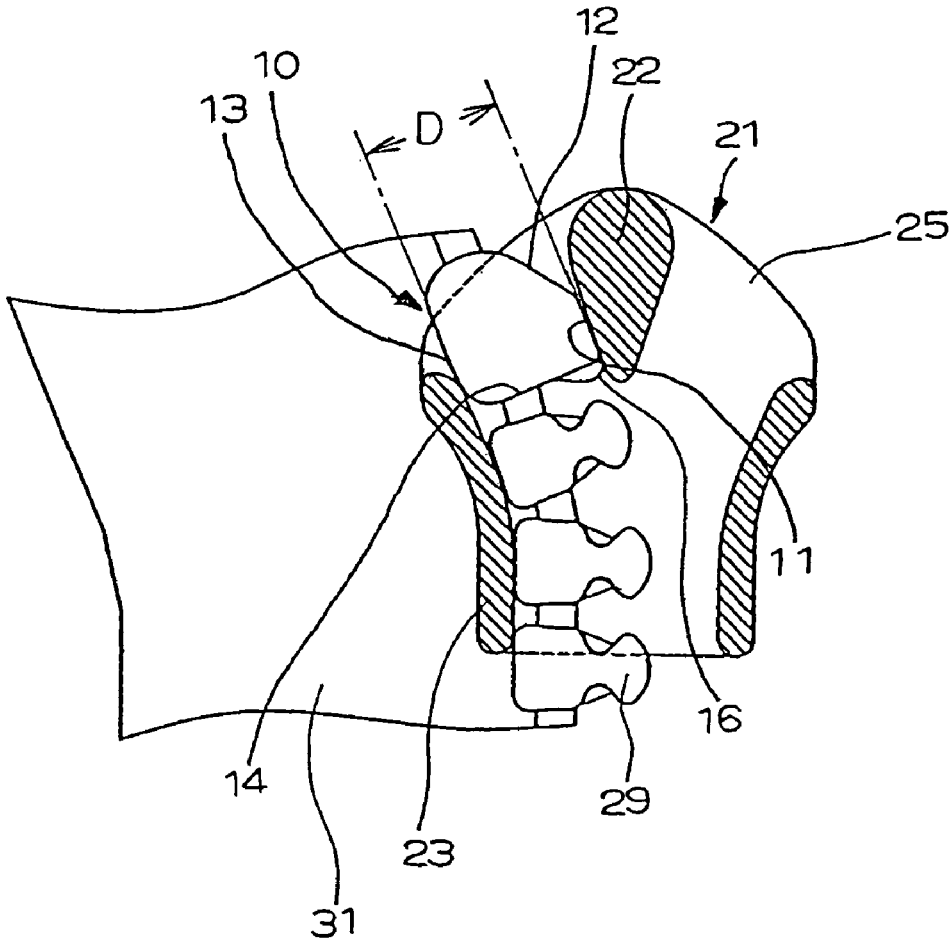
FIG. 5 is a rear view of the top end stop of FIG. 4 in the same slide fastener.

After the passage of the top end stop 10 is completed, even if the top end stop 10 is inserted into the element aisle 24 between the guide column 22 of the slider 21 and the flange 23 as shown in FIG. 4, its posture never tilts and thus, the top end stop 10 cannot pass through the element aisle 24. As for this posture, the first opposing side face 11 of the top end stop 10 opposes the guide column 22 of the slider 21, and the opposite side face 13 of the top end stop 10 opposes the flange 23 of the slider 21, so that the front end of the flange 23 engages the cut-out 17 provided in the opposite side face 13. Because the interval A between the first opposing side face 11 and the opposite side face 13 is larger than the width C of the element aisle 24 between the guide column 22 and the flange 23, the top end stop 10 cannot pass through the element aisle 24.

Figure 6:
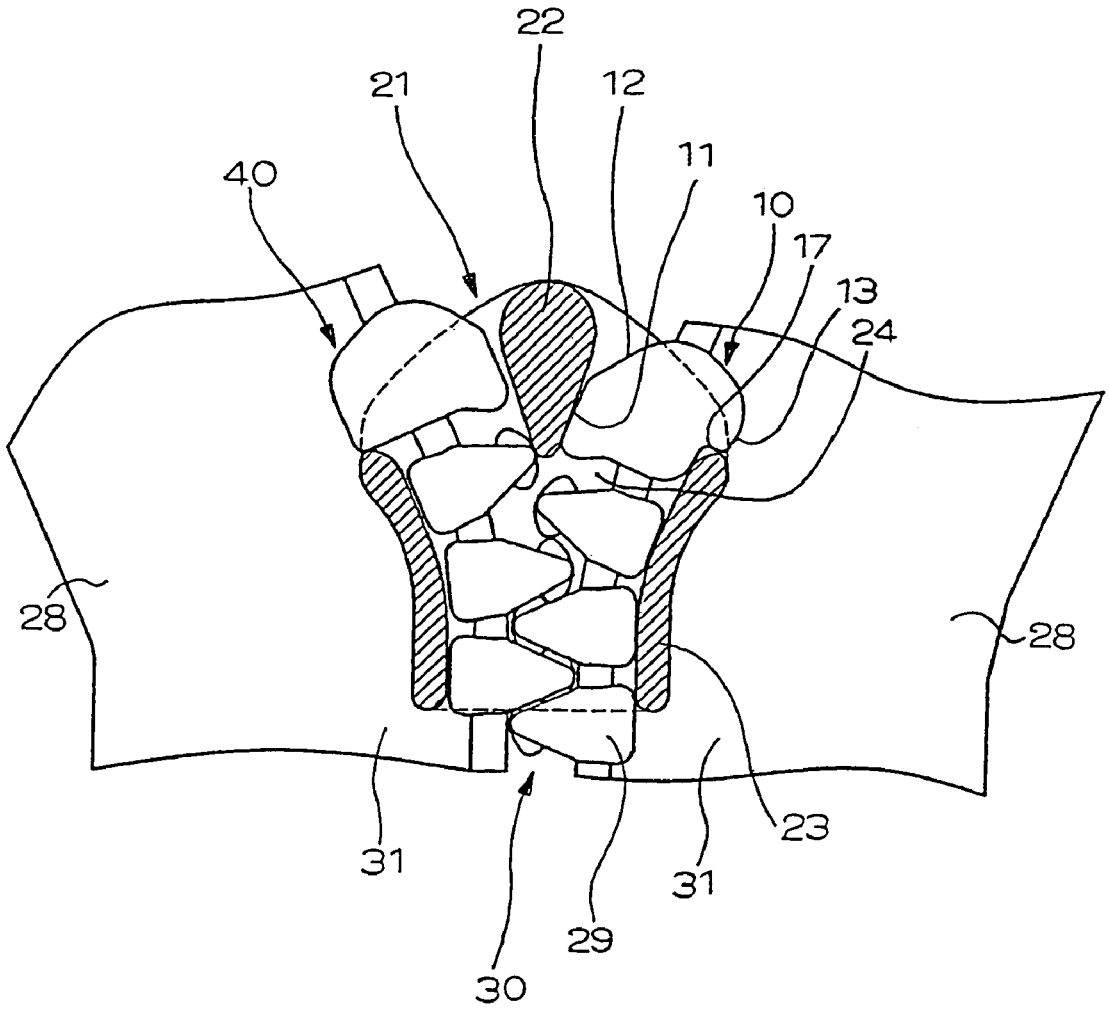
FIG. 6 is a sectional view of major portions showing the engagement condition between the slider and the top end stop in the same slide fastener.

A top end stop 40 attached to the top end of the fastener stringer 31 or the fastener stringer 31 provided with the separable pin 7 engages the front end of the flange 23 of the slider 21 as shown in FIG. 6, while the top end stop 10 attached to the top end of the other fastener stringer 31 or the fastener stringer 31 provided with the box pin 6 engages the flange 23. Consequently, even if the slider 21 is pulled forcibly, it never escapes from the top end stops 10, 40.

(Second Embodiment)

Figure 8:
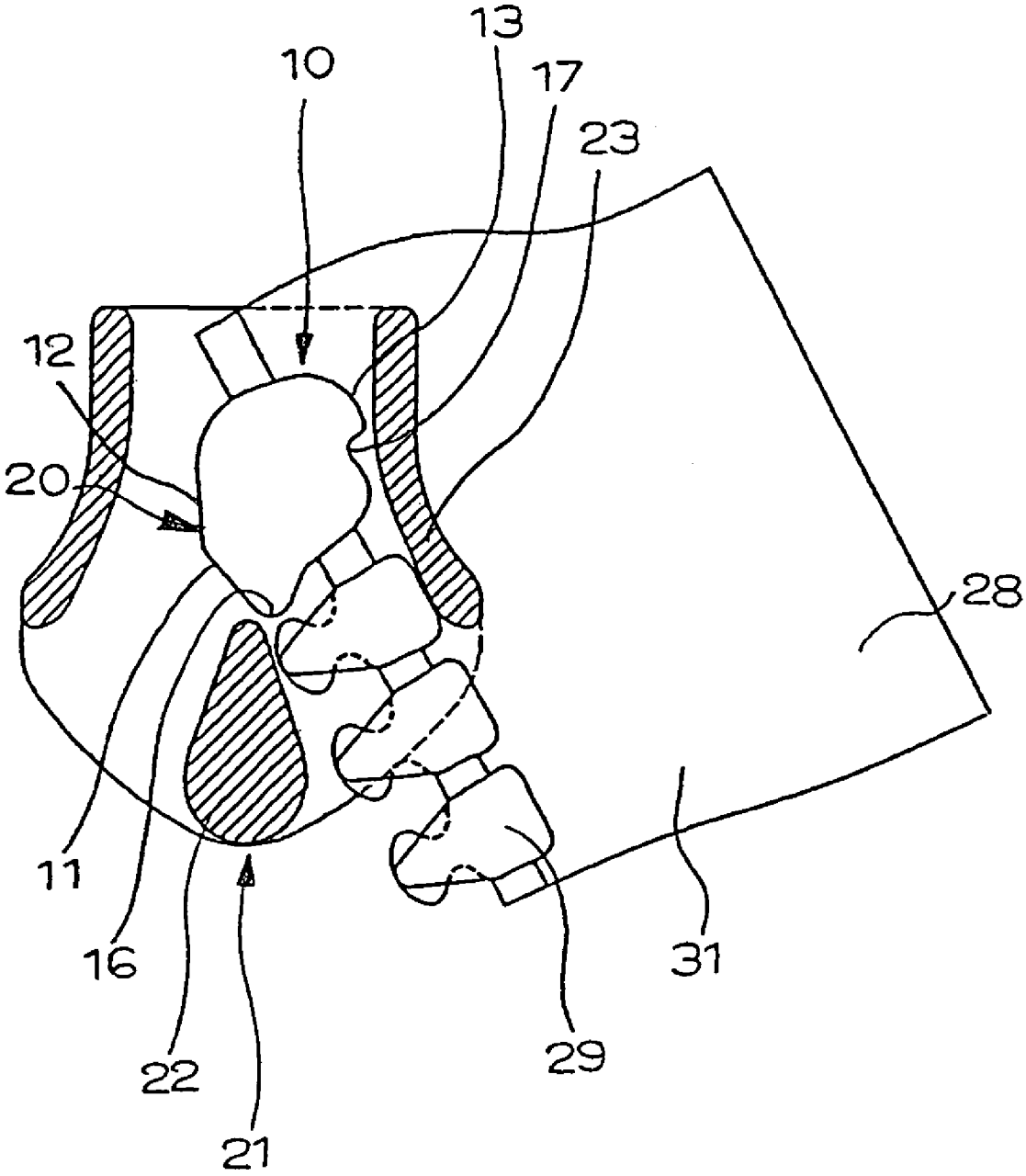
FIG. 8 is an operation explanatory view showing a condition in which the slider is being pulled out by inserting the top end stop into the slider on the bottom side of the same slide fastener.

In a slide fastener according to a second embodiment of the present invention shown in FIGS. 7 and 8, the top end stop 10 is attached to the slide fastener having the inverse opening device 2 at an end portion of the fastener chain 30 as shown in FIG. 7. The box pin 6 and the reinforcement portion 8 are formed at an end of one fastener tape 28 using resin, the fastener elements 29 of a predetermined length are formed on the side edge of the fastener tape 28 and then, the top end stop 10 is formed adjacent to the fastener elements 29. The separable pin 7 and the reinforcement portion 8 are formed at an end of the other fastener tape 28, the fastener elements 29 of a predetermined length are formed on the side edge of the fastener tape 28 and then, the top end stop 40 is formed adjacent to the fastener elements 29. Because the configurations of the top end stops 10, 40 are identical to the top end stop 10 of the first embodiment, description thereof is omitted.

The usage condition of the slide fastener provided with the inverse opening device will be described. By inserting the end portion of the fastener stringer 31 provided with the box pin 6 with the slider 21 tilted slightly in its opposite direction as shown in FIG. 8, the slider 21 can be set on the fastener stringer 31. After the insertion, the inverse opening device 2 is formed with the slider 21 kept in contact with the box pin 6. Next, the top end stop 10 is inserted through the slider 21 while changing its tilted status in the same manner as in the first embodiment, and after this slider 21 is brought into contact with the slider 21 on the bottom end, the separable pin 7 of the other fastener stringer 31 is inserted into the upper slider 21 and the lower slider 21 and then, by sliding the upper slider 21, the slide fastener is closed.

The projecting portion 16 projected from the corner between the first opposing side face 11 and the bottom end face 14 of the top end stop 10 functions to fill a gap between the head of the forefront of the fastener elements 29 and the top end stop 10 as shown in FIG. 8, thereby blocking the V-shaped front end of the guide column 22 of the slider 21 from biting into between the fastener elements 29 and the top end stop 10, when removing the slider 21 for inverse opening from the fastener stringer 31 having the box pin 6 provided with the inverse opening device 2.

(Third Embodiment)

Figure 9:
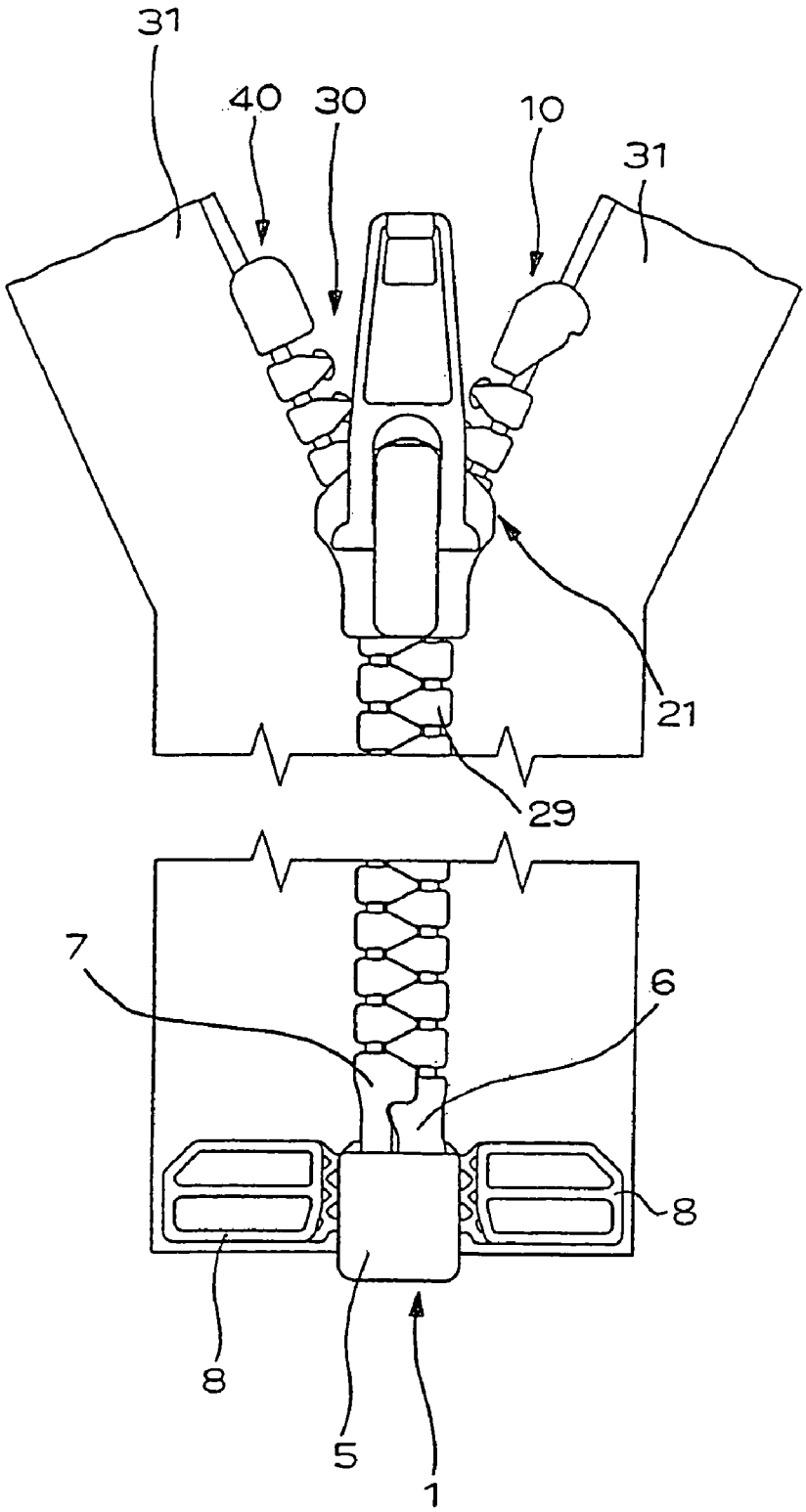
FIG. 9 is a front view of a slide fastener with an opening device according to a third embodiment of the present invention.
Figure 10:
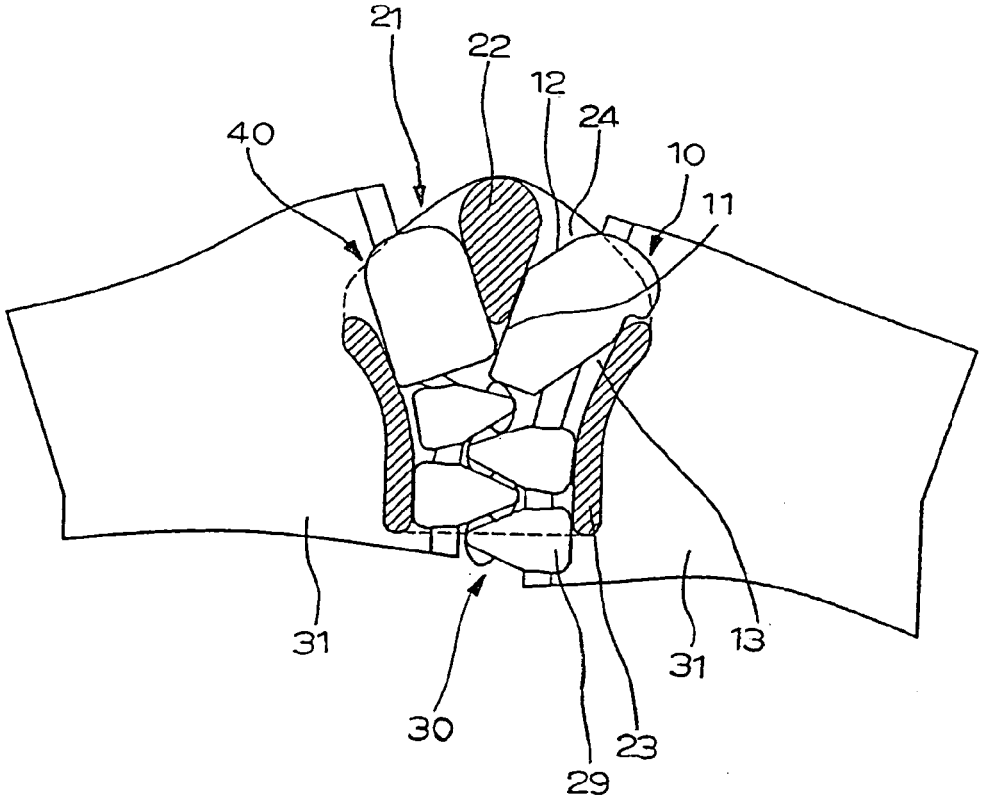
FIG. 10 is a sectional view of major portions showing the engagement condition between the top end stop and the slider in the same slide fastener.
Figure 11:
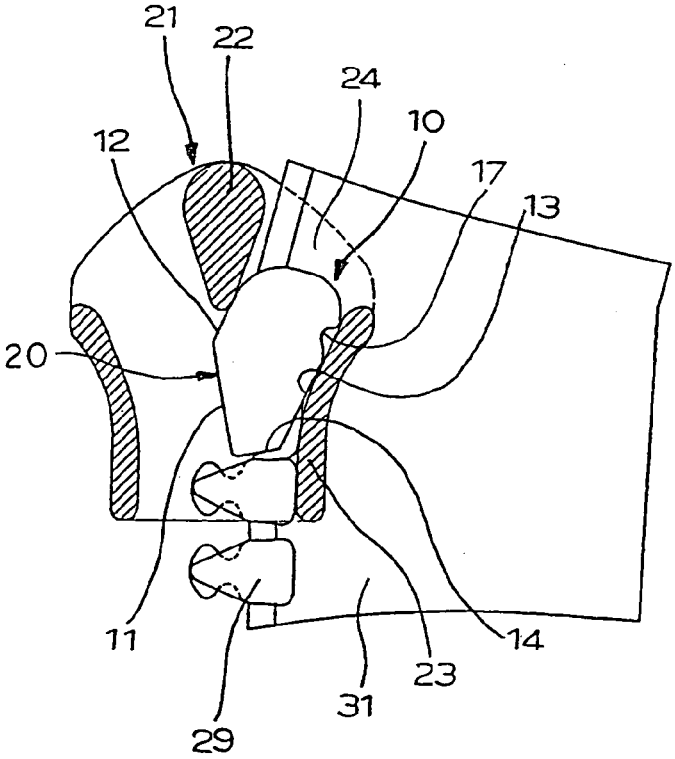
FIG. 11 is an operation explanatory view showing a condition in which the top end stop passes through the element aisle between the guide column and the flange by inserting it into the slider in the same slide fastener.

A slide fastener according to a third embodiment of the present invention shown in FIGS. 9 to 11 shows a modification of the top end stop and has an identical configuration to the slide fastener of the first embodiment except the top end stop 10. In the top end stop 10 adjacent to the fastener elements 29 of the top end of the fastener stringer 31 provided with the box pin 6, the interval A between the first opposing side face 11 and the opposing side face 13 is larger than the interval B between the second opposing side face 12 and the opposite side face 13, and the second opposing side face 12 and the opposite side face 13 are in parallel to each other while the cut-out 17 is formed in the opposite side face 13. The interval B is equal to or slightly smaller than the width C of the element aisle 24 on the side face of the guide column 22 of the slider 21. The first opposing side face 11 is formed longer than that in the first embodiment, while the first opposing side face 11 and the bottom end face 14 intersect each other at right angle, and the top end face 15 is formed in a circular face. The top end stop 40 to be attached to the end portion of the fastener stringer 31 provided with the separable pin 7 is formed long corresponding to the opposing top end stop 10.

As for the usage condition of the top end stop 10, when setting the slider 21 on the fastener stringer 31 provided with the box pin 6, the top end stop 10 is inserted into the slider 21 while changing its tilted status in the same manner as in the first embodiment as shown in FIG. 11. After sliding the slider up to the opening device 1, the separable pin 7 of the other fastener stringer 31 is inserted and then, the slider 21 is slide upward to close the slide fastener. At this time, as shown in FIG. 10, the corner portion of the other top end stop 40 makes contact with the first opposing side face 11 of the top end stop 10, thereby blocking the sliding of the slider 21 upward together with the cut-out 17.

(Fourth Embodiment)

Figure 12:
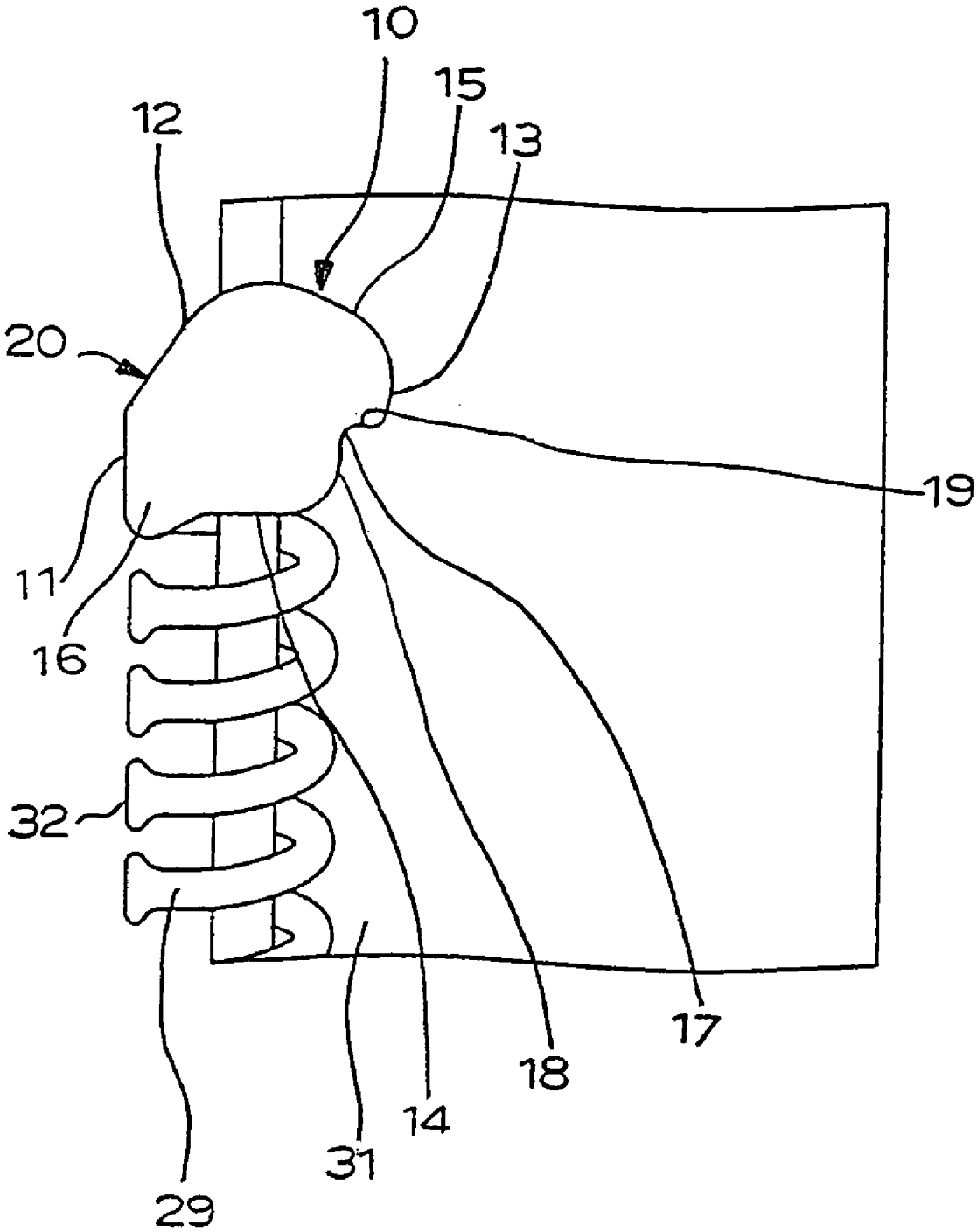
FIG. 12 is a front view of a fastener stringer formed of coil-like fastener elements according to a fourth embodiment of the present invention.

A slide fastener according to a fourth embodiment of the present invention shown in FIG. 12 indicates a modification of the fastener elements to be attached to the fastener tape. A space portion is formed at a predetermined interval in the endless fastener chain 30 in which continuous fastener elements 29 composed of coil-like wound polyamide or polyester monofilament are attached by putting a core thread through on the side edge of the fastener tape 28. The opening device 1 or the inverse opening device 2 is formed at an end of this space portion such that it is continuous with the fastener elements 29, and the top end stop 10 is formed at the other end adjacent to the fastener elements 29. The configuration of the top end stop 10 is identical to the top end stop 10 shown in the respective embodiments. The continuous fastener elements 29 may be formed in the zigzag shape.

(Fifth Embodiment)

Figure 13:
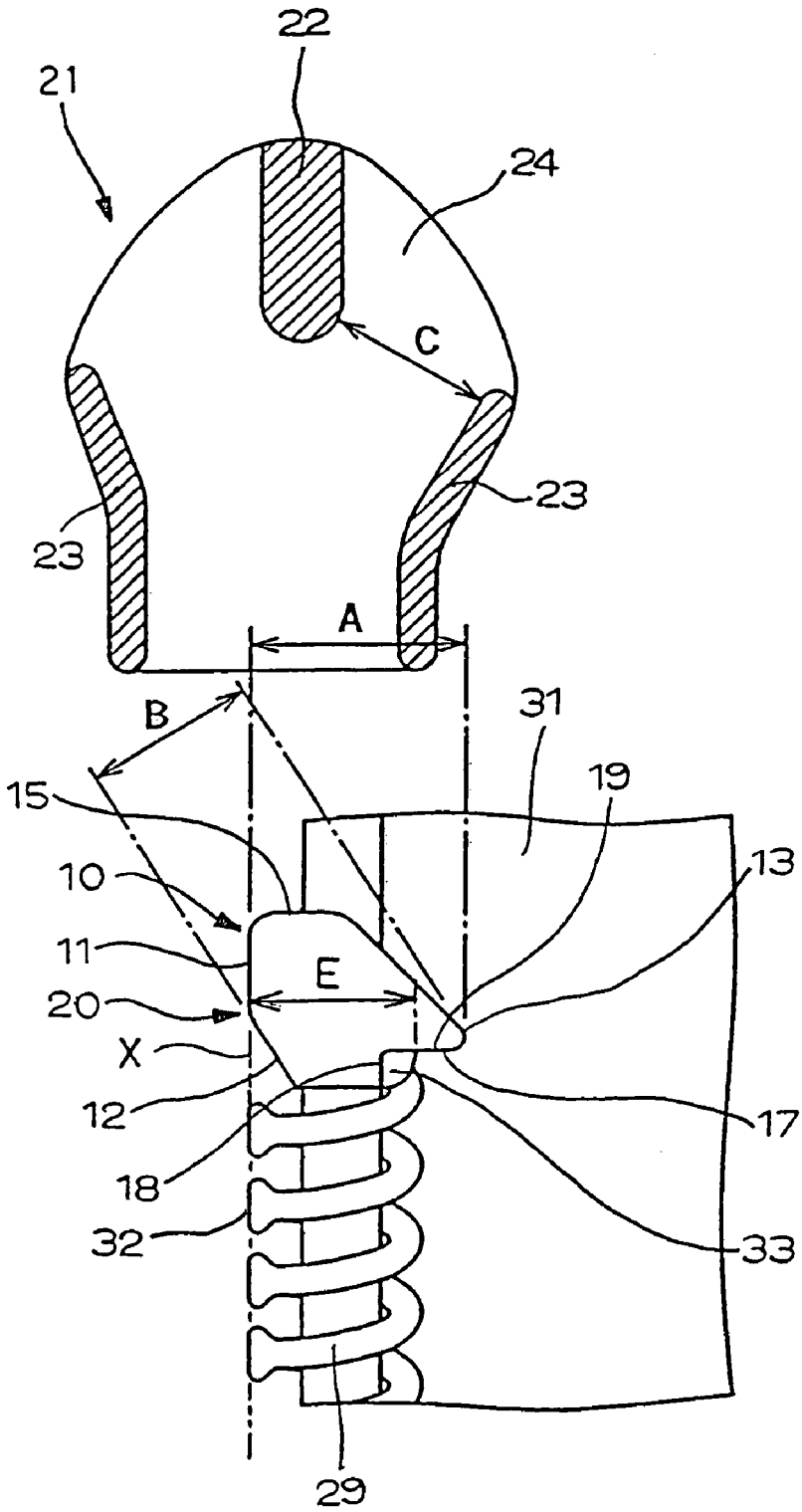
FIG. 13 is a front view of a fastener stringer formed of the coil-like fastener elements according to a fifth embodiment of the present invention.

In a slide fastener according to a fifth embodiment of the present invention shown in FIGS. 13 to 16, as shown in FIG. 13, the top end stop 10 is formed integrally continuous with the coil-like fastener elements 29. As for the configuration of the top end stop 10, as shown in FIG. 13, the top end stop 10 opposes the side face of the guide column 22 of the slider 21. The opposing side face 20 is provided and comprises the second opposing side face 12 located on a side adjacent to the fastener elements 29, and the first opposing side face 11 which is located adjacent to the second opposing side face 12 and on the side of an end portion the fastener stringer 31 or the side of the top end face 15 of the top end stop 10. The first opposing side face 11 and the second opposing side face 12 are constructed with an angle in the range of 140° to 150° formed therebetween.

As for the first opposing side face 11 and the second opposing side face 12, the first opposing side face 11 is disposed on the end portion of the fastener stringer 31 or the side of the top end face 15 of the top end stop 10. The second opposing side face 12 is disposed on the side adjacent to the fastener elements 29 of the fastener stringer 31 and continuous with the first opposing side face 11. The first opposing side face 11 is so formed to be located on a line X connecting the front ends of the heads 32 of the fastener elements 29 of the fastener stringer 31 and protrude from the edge of the fastener stringer 31. The second opposing side face 12 is formed so as to be tilted inward of the top end stop 10, that is, inward of the fastener stringer 31.

The cut-out 17 is provided in the bottom on an opposite side to the opposing side face 20 so that the front end of the flange 23 of the slider 21 is capable of engaging. The cut-out 17 has the upper side portion 19 and the lower side portion 18. The step portion 33 which is retreated further and circularly shaped is provided at the proximal portion of the cut-out 17 so as to guide the flange 23 of the slider 21 smoothly. The interval E between the root in which the upper side face 19 makes contact with the step portion and the first opposing side face 11 is equal to or slightly smaller than the width C of the element aisle 24 between the guide column 22 of the slider 21 and the flange 23. The interval A between the first opposing side face 11 and the outer end of the cut-out 17 is larger than the interval B between the second opposing side face 12 and the outer end of the cut-out 17. The interval B is equal to or slightly smaller than the width C of the element aisle 24 between the guide column 22 and the flange 23. The opposite side face 13, which opposes the second opposing side face 12, is formed to be tilted from the outer end of the cut-out 17 to the top end face 15, so that a gradually narrowed shape is formed. Consequently, the top end stop 10 can be inserted into the slider 21 smoothly.

Figure 14:
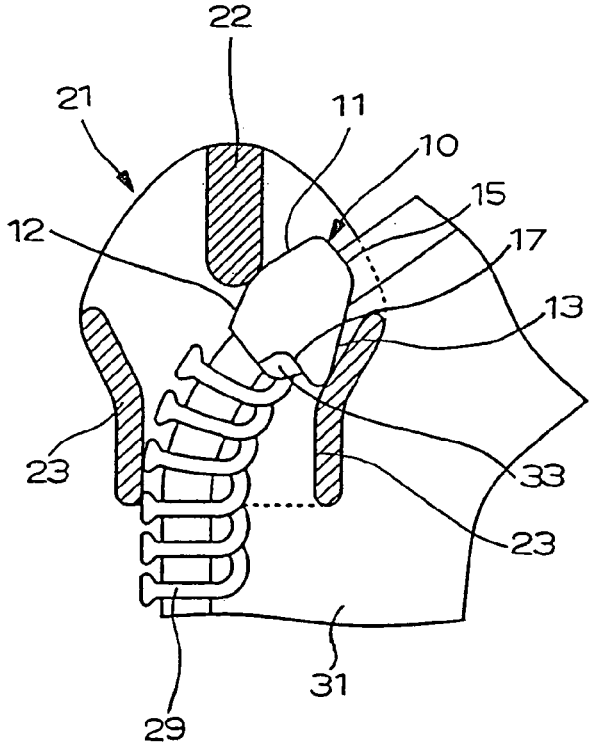
FIG. 14 is an operation explanatory view showing a condition in which the top end stop is inserted into the element aisle in the same slide fastener.
Figure 15:
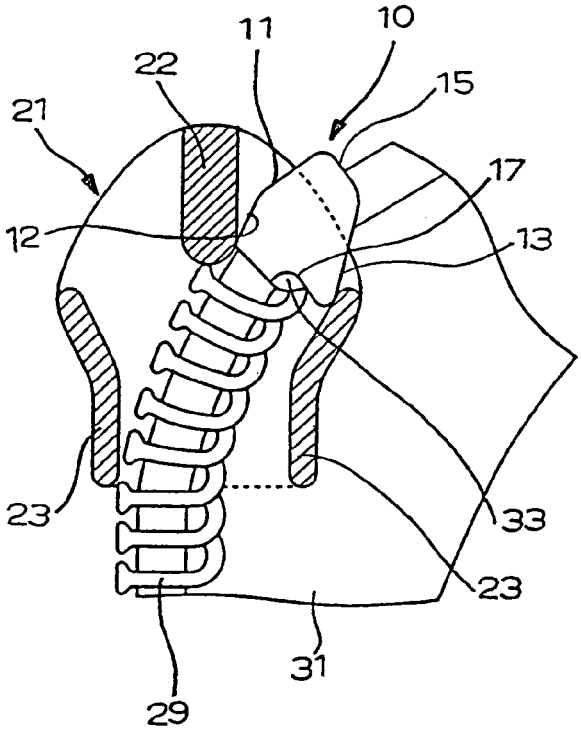
FIG. 15 is an operation explanatory view showing a condition in which the top end stop is passed through the element aisle of the same slide fastener.
Figure 16:
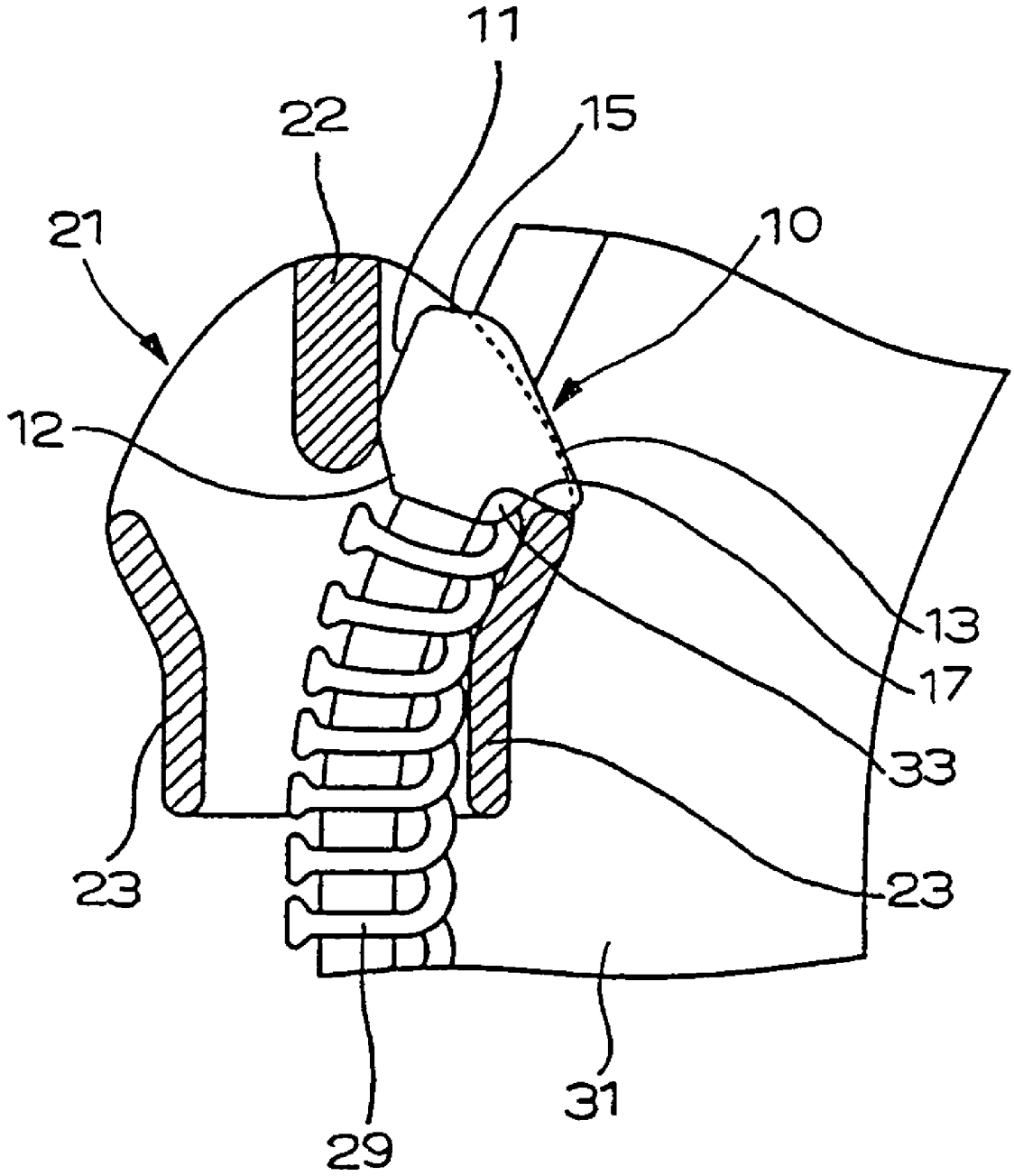
FIG. 16 is an operation explanatory view showing a condition after the top end stop is passed in the same slide fastener.

When inserting the top end stop 10 having such a configuration and attached to the fastener stringer 31, the gradually narrowed end portion of the top end face 15 is introduced into the element aisle 24 from the rear mouth of the slider 21 first as shown in FIG. 14. If the slider 21 is inserted while rolling in the left direction, the top end stop 10 changes into such a posture that as shown in FIG. 15, the opposing side face 20 passes by the side face of the guide column 22 easily. Further, if the end portion of the fastener stringer 31 is pulled, the top end stop 10 escapes completely from the slider 21 as shown in FIG. 16. At the same time, the outer end of the cut-out 17 engages the front end of the flange 23, thereby preventing the slider 21 from being loose. Thereafter, the slider 21 is slid up to the box or the inverse opening device and set up. Then, after the separable pin is inserted, the slider 21 is slid in the closing direction to close the fastener chain. In the meantime, when removing the slider 21 from the fastener stringer 31, the top end stop 10 is inserted into the slider 21 while rolling the slider 21 in the right direction and then, by pulling the fastener stringer 31 downward, the slider 21 can be removed easily.

(Sixth Embodiment)

Figure 17:
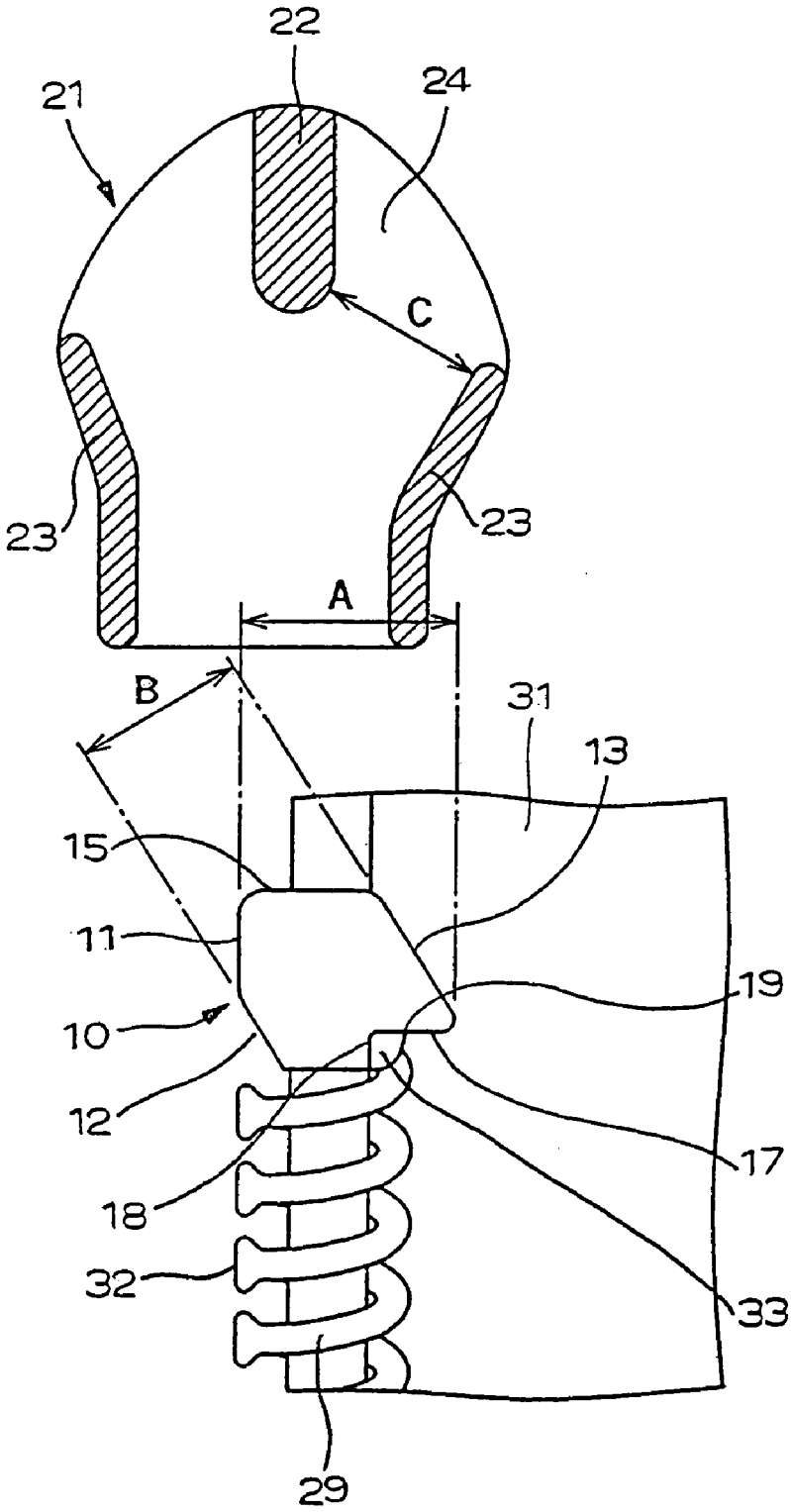
FIG. 17 is a front view of a top end stop of a fastener stringer formed of coil-like fastener elements according to a sixth embodiment of the present invention.
Figure 18:
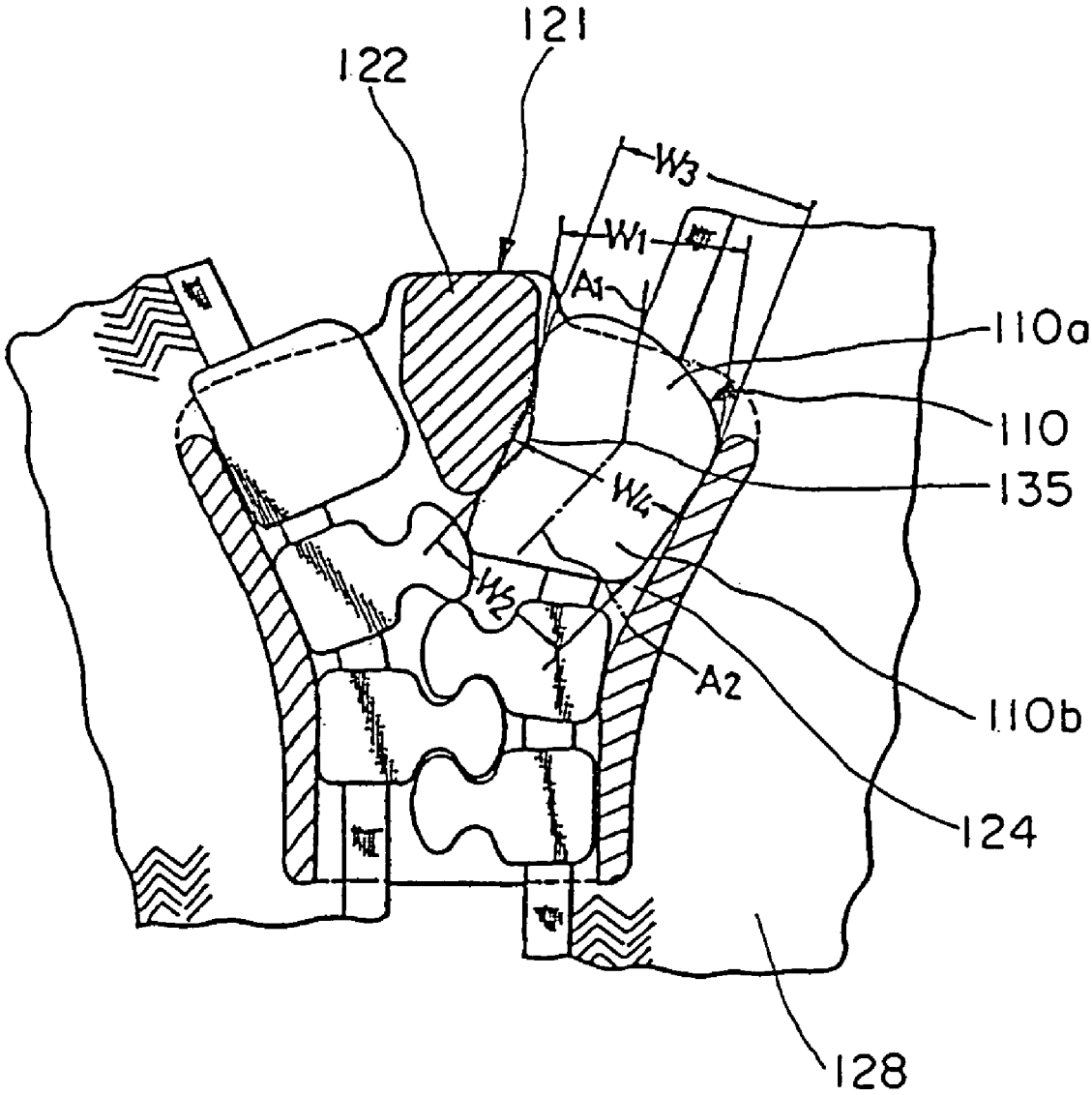
FIG.18 PRIOR ART
FIG. 18 is a front view of a top end stop of a well known slide fastener.

A top end stop of a slide fastener according to a sixth embodiment of the present invention shown in FIG. 17 is substantially identical to the top end stop 10 of the fifth embodiment except that the opposite side face 13 on the opposite side to the opposing side face 20 is disposed in parallel to the second opposing side face 12. The usage condition is the same as in the fifth embodiment.

As an example of application of the top end stop of the slide fastener of the present invention, when sewing the fastener stringer on clothes or other product for the slide fastener provided with the opening device or inverse opening device to be mounted along an opening portion of various kinds of clothes or an opening portion in shoes, bag or the like, the slider set on the stringer is obstructive thereby complicating the sewing operation to lead to increase in cost. For the reason, the slider is removed before the sewing, and after the sewing, it is set on the fastener stringer. Further, in a slider fastener on use, its slider can be replaced with a different slider.

What is claimed is:

1. A top end stop of a slide fastener comprising an opening device or an inverse opening device having a box pin and a separable pin at an end portion of a pair of fastener stringers, the top end stop being attached adjacent to a top end of plurality of fastener elements on a side of the box pin and capable of passing through an element aisle provided in a slider by changing its posture, wherein the slider comprises an upper plate and a lower plate disposed up and down in parallel being joined with a guide column on a shoulder mouth side, a flange protruding toward the lower plate and/or the upper plate from right and left side edges of the upper plate and/or the lower plate, and the element aisle formed so as to be surrounded by the upper plate, the lower plate, the guide column and the flange, the top end stop is comprised of a first side face opposing the guide column of the slider and a second side face on an opposite side to the first side face and on a side of the flange, while a cut-out for engaging the flange of the slider is provided in the second side face, the first side face of the top end stop has a first opposing side face and a second opposing side face, an interval A between the first opposing side face and the second side face is formed to be larger than a width C of the element aisle between the guide column and the flange of the slider, while an interval B between the second opposing side face and the second side face is formed to be equal to or smaller than the width C, and the top end stop is formed so that the top end stop with the interval B passes through the width C and the cut-out makes contact with a front end of the flange with the interval A.

2. The top end stop of the slide fastener according to claim 1, wherein the cut-out of the top end stop has an upper side portion and a lower side portion, the upper side portion makes contact with a front end of the flange and an interval E between the lower side portion and the first side face is formed to be equal to or slightly smaller than a width C of the element aisle.

3. The top end stop of the slide fastener according to claim 1, wherein the first opposing side face and the second opposing side face intersect at an angle of 140° to 150°.

4. The top end stop of the slide fastener according to claim 1, wherein the second opposing side face is disposed on a side of a top end of the top end stop such that it adjoins the first opposing side face, and the second opposing side face is formed to be tilted toward an inward of the fastener stringer.

5. The top end stop of the slide fastener according to claim 1, wherein the first opposing side face is disposed on a side of a top end of the top end stop, and the second opposing side face is disposed on a side of a bottom end of the top end stop such that it adjoins the first opposing side face, and the second opposing side face is formed to the tilted inward toward the bottom end of the top end stop.

6. The top end stop of the slide fastener according to claim 1, wherein a side face of the opposite side to the second opposing side face is formed such that it is narrowed gradually from an outer end of the cut-out toward a top end of the top end stop.

7. The top end stop of the slide fastener according to claim 1, wherein a region of a bottom end portion surrounded with the first side face and the second side face is formed to be narrowed gradually toward the bottom end thereof.

8. The top end stop of the slide fastener according to claim 1, wherein the first opposing side face is formed on a side of a bottom end of the top end stop, the first opposing side face and a side face of an opposite side thereto are formed to be in parallel to each other and an interval D therebetween is equal to or smaller than the width C.

9. The top end stop of the slide fastener according to claim 1, wherein the interval A between the first opposing side face and the second side face is the interval between the first opposing side face and the outer end of the cut-out formed in the second side face, and the interval B between the second opposing side face and the second side face is the interval between the second opposing side face and the outer end of the cut-out.

* * * * *